US009500093B2

(12) United States Patent
Papple

(10) Patent No.: US 9,500,093 B2
(45) Date of Patent: Nov. 22, 2016

(54) INTERNALLY COOLED AIRFOIL

(71) Applicant: Pratt & Whitney Canada Corp., Longueuil (CA)

(72) Inventor: Michael Papple, Verdun (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 556 days.

(21) Appl. No.: 14/037,948

(22) Filed: Sep. 26, 2013

(65) Prior Publication Data

US 2015/0086381 A1 Mar. 26, 2015

(51) Int. Cl.
*F01D 5/18* (2006.01)
*F01D 9/06* (2006.01)

(52) U.S. Cl.
CPC ..... *F01D 9/065* (2013.01); *F01D 5/187* (2013.01); *F05D 2260/2212* (2013.01); *F05D 2260/22141* (2013.01)

(58) Field of Classification Search
CPC ..... F01D 5/18; F01D 5/186; F01D 5/187; F01D 5/188; F01D 5/189; F01D 9/06; F01D 9/065; F05D 2260/22141; F05D 2260/2212
See application file for complete search history.

(56) References Cited

U.S. PATENT DOCUMENTS

| | | | | |
|---|---|---|---|---|
| 4,407,632 | A | 10/1983 | Liang | |
| 4,514,144 | A * | 4/1985 | Lee | B22C 9/04 416/96 R |
| 6,331,098 | B1 * | 12/2001 | Lee | F01D 5/187 416/97 R |
| 6,808,367 | B1 * | 10/2004 | Liang | F01D 5/187 415/115 |
| 6,984,102 | B2 * | 1/2006 | Bunker | F01D 5/187 415/115 |
| 7,186,084 | B2 * | 3/2007 | Bunker | F01D 5/187 416/241 R |
| 7,544,044 | B1 | 6/2009 | Liang | |
| 7,690,894 | B1 | 4/2010 | Liang | |
| 8,317,475 | B1 | 11/2012 | Downs | |

* cited by examiner

*Primary Examiner* — Craig Kim
*Assistant Examiner* — Julian Getachew
(74) *Attorney, Agent, or Firm* — Norton Rose Fulbright Canada LLP

(57) ABSTRACT

An internally cooled airfoil for a gas turbine engine has a hollow airfoil body including pressure and suction sidewalls defining a cooling passage therebetween. A combination of pedestal and trip-strips are used in the cooling passage to enhance heat transfer while minimizing the coolant pressure drop across these features.

19 Claims, 4 Drawing Sheets

INTERNALLY COOLED AIRFOIL

TECHNICAL FIELD

The application relates generally to gas turbine engines and, more particularly, to airfoil cooling.

BACKGROUND OF THE ART

Gas turbine engine design mainly focuses on efficiency, performance and reliability. Efficiency and performance both favour high combustion temperatures, which increase thermodynamic efficiency, specific thrust and maximum power output. Unfortunately, higher gas flow temperatures also increase thermal and mechanical loads, particularly on the turbine airfoils. This reduces service life and reliability, and increases operational costs associated with maintenance and repairs.

Therefore, there continues to be a need for new cooling schemes for turbine airfoils.

SUMMARY

In one aspect, there is provided an internally cooled airfoil for a gas turbine engine, comprising a hollow airfoil body having opposed pressure and suction sidewalls defining therebetween a cooling passage, and a plurality of pedestals extending across said cooling passage from said pressure sidewall to said suction sidewall, wherein at least some of said pedestals have a trip-strip portion projecting laterally therefrom a distance less than the distance between two adjacent pedestals.

In a second aspect, there is provided an internally cooled airfoil for a gas turbine engine, comprising a hollow airfoil body having opposed pressure and suction sidewalls defining therebetween a cooling passage, a plurality of pedestals staggered in a trailing edge region of the cooling passage and extending from said pressure sidewall to said suction sidewall, and a plurality of trip-strips provided on an inner surface of at least one of said pressure and suctions sidewalls, each of said trip-strips having a proximal end attached to an associated one of said pedestals and a distal end spaced-apart from adjacent pedestals.

In accordance with a third aspect, there is provided a gas turbine engine component comprising a surface to be cooled by a flow of coolant, a plurality of pedestals staggered on said surface, and a plurality of trip-strips provided on said surface, each of said trip-strips having a proximal end attached to an associated one of said pedestals and a distal end spaced-apart from adjacent pedestals.

DESCRIPTION OF THE DRAWINGS

Reference is now made to the accompanying figures, in which.

DETAILED DESCRIPTION OF THE PREFERRED EMBODIMENTS

Figure 1:
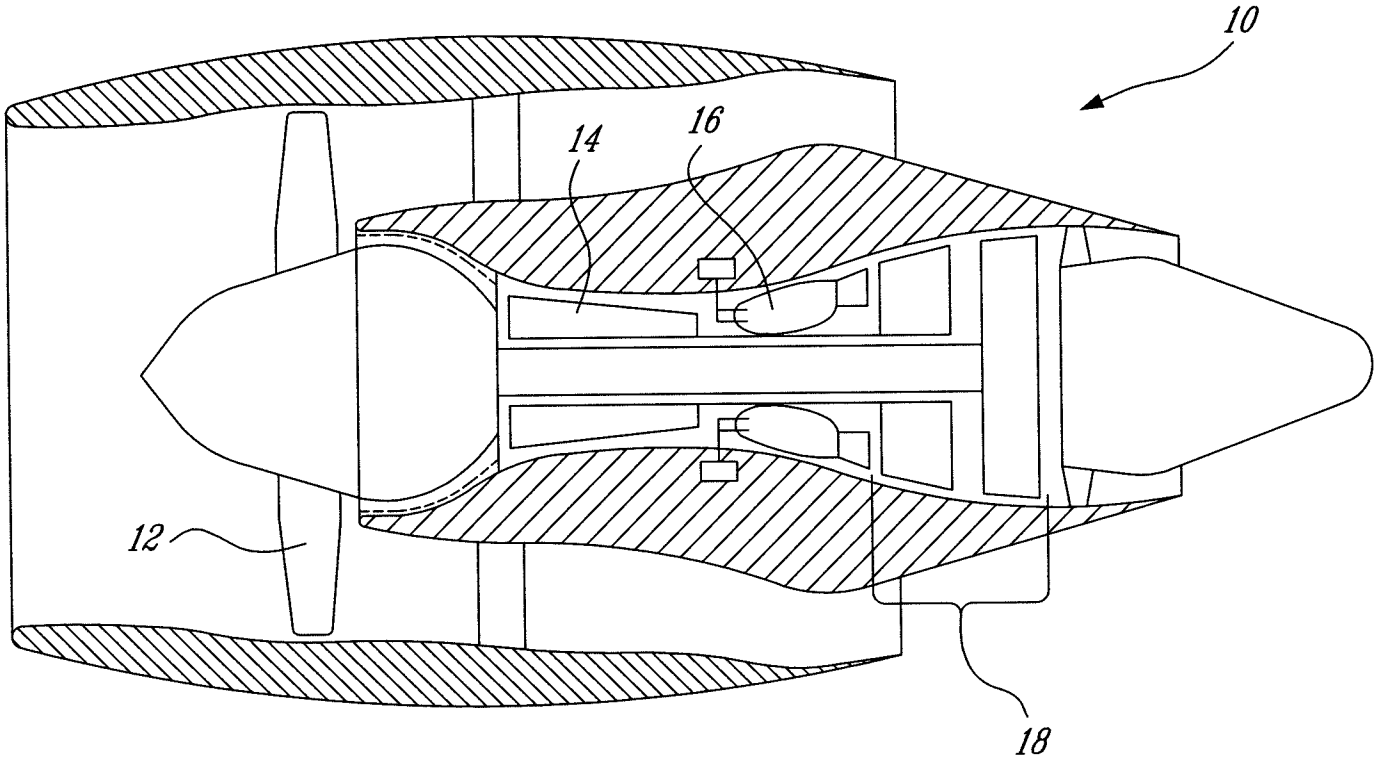
FIG. 1 is a schematic cross-sectional view of a turbofan gas turbine engine.
Figure 3:
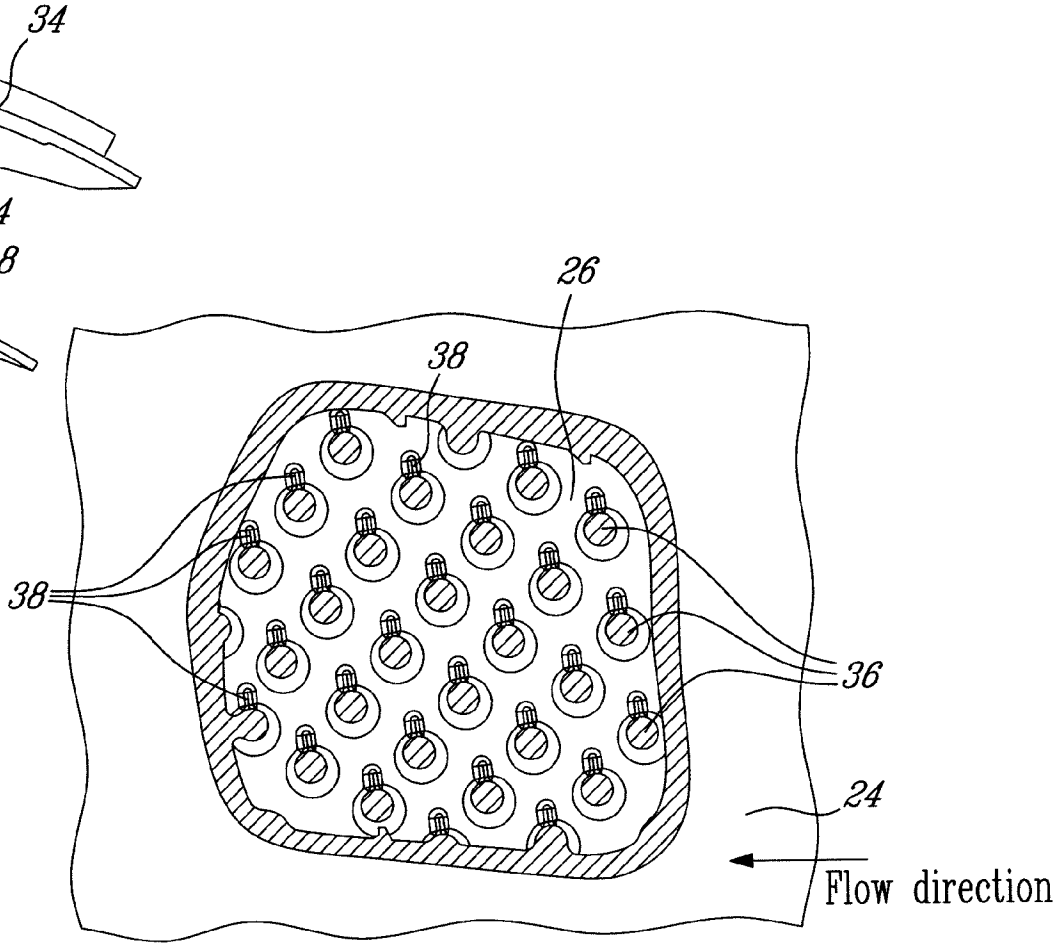
FIG. 3 is an enlarged view of the broken away portion of FIG. 2 illustrating the pedestals with their trip-strip portions on the side.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
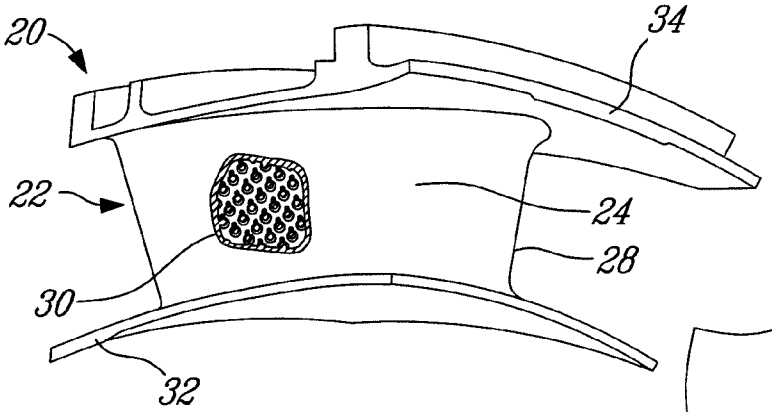
FIG. 2 is an exploded isometric view of an internally cooled turbine vane with a portion of the concave pressure side wall of the vane removed to show the integration of trip-strips on the sides of pedestals in a trailing edge region of the hollow airfoil body of the vane.

The turbine section 18 may have various numbers of stages. Each stage comprises a row of circumferentially distributed stator vanes followed by a row of circumferentially distributed rotor blades. FIG. 2 illustrates a turbine vane 20 having an internal cooling structure in accordance with a first embodiment of the present invention. The turbine vane 20 has a hollow airfoil body 22 including a concave pressure side wall 24 and a convex suction side wall 26 extending chordwise from a leading edge 28 to a trailing edge 30. The hollow airfoil body 22 extends spanwise between inner and outer platforms 32 and 34. The hollow airfoil body 22 and the platforms 32, 34 may be integrally cast from a high temperature resistant material. The pressure and suction sidewalls 24, 26 define therebetween an internal cooling passage 33 (FIGS. 4 and 5) adapted to be connected to a source of coolant, such as compressor bleed air. The passage 33 may adopt various configurations. For instance, the passage may define a serpentine flow cooling circuit from a leading edge region to a trailing edge region of the airfoil body 22. Discharge holes (not shown) may be defined in the trailing edge of the airfoil for discharging coolant from the trailing edge region of the cooling passage 33.

Referring concurrently to FIGS. 2 to 5, it can be appreciated that the cooling passage 33 may be provided with a combination of pedestals 36 and trip-strips 38 at least in the trailing edge region. The pedestals 36 are staggered in the trailing edge region and extend across the cooling passage 33 from the pressure sidewall 24 to the suction sidewall 26. The pedestals 36 may have a generally cylindrical configuration with opposed frusto-conical end portions. The trip-strips 38 are integrated to the end portions of the pedestals 36 on the inner surface of at least one of the pressure and suctions sidewalls 24, 26. Each trip-strip 38 extends from an associated one of the pedestals 36 only partway between adjacent pedestals 36. Each trip-strip 38 extends only a short distance laterally from its associated pedestal 36 in order to minimize the pressure drop of the coolant zigzagging around the pedestals 36 and flowing over the trip-strips 38 attached thereto. According to one embodiment, the length of the trip-strip may vary from about 10 to 90% of the lateral distance between adjacent pedestals, however the preferred length is 25 to 50% of this distance such that the trip-strip on the pressure-side does not overlap with the trip-strip on the suction-side.

As mentioned above, the trip-strips 38 do not extend all the way from pedestal-to-pedestal. Rather, each trip-strip 38 has a free distal end 38*a* which is spaced from the adjacent pedestals (i.e. the trip-strips 38 do not interconnect the pedestals 36; the pedestals 36 are only interconnected by the pressure and suction sidewalls 24, 26).

Figure 5:
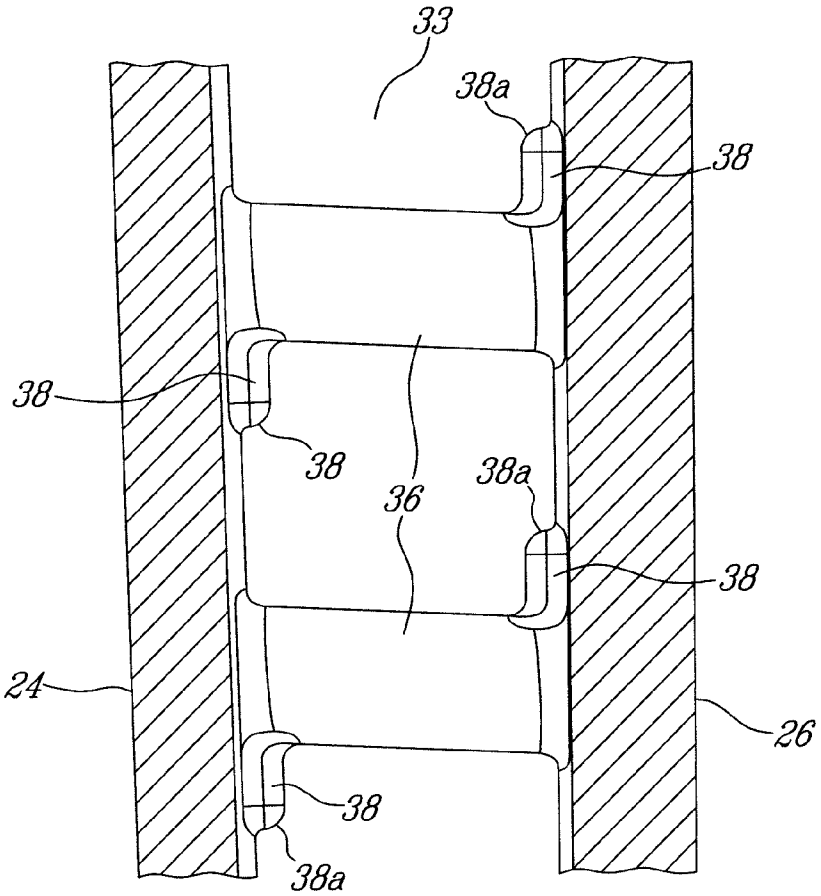
FIG. 5 is an enlarged view of region A in FIG. 4.

As can be appreciated from FIG. 5, the trip-strip height is small compared to the pedestal height. The trip-strips may be provided in the form of low profile ribs on the inner surface of the pressure and suctions sidewalls 24, 26. According to one embodiment, the trip-strip height may generally correspond to the thickness of the boundary layer of the coolant flowing over the inner surface of the pressure and suction sidewalls 24, 26. The trip-strip height may be just sufficient to trip the boundary layer of the coolant. According to one embodiment, the ratio trip-strip height/pedestal height ranges from about 0.05 to about 0.25.

By providing trip-strips having a small height compared to the pedestal height, and by providing trip-strips that do not extend all the way from pedestal to pedestal, the coolant pressure drop may be minimized while still providing for enhanced heat transfer.

The trip-strips 38 may be oriented generally perpendicularly to the primary flow direction of the coolant flowing through the trailing edge region of the cooling passage 33. With this trip-strip orientation, the coolant flow path is still primarily back and forth. This contributes to avoiding creating vortex-like flow paths which would result in greater coolant pressure losses.

Figure 4:
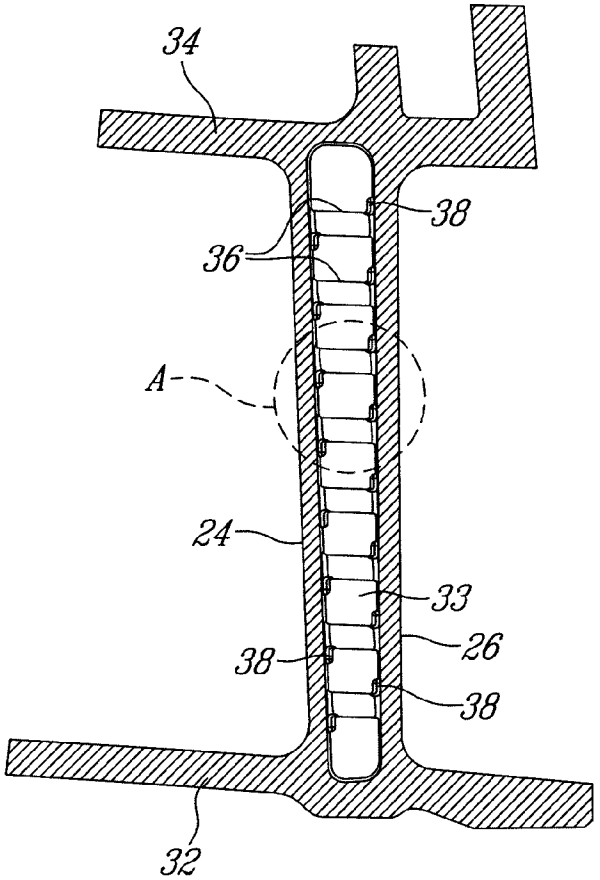
FIG. 4 is a cross-section view illustrating one row of pedestals integrated with trip-strips in the trailing edge region of the hollow airfoil body of the vane.

As shown in FIGS. 4 and 5, the trip-strips 38 may be provided on the inner surface of both the pressure and suctions sidewalls 24, 26. For instance, each pedestal 36 may have first and second trip-strip portions extending from opposed ends thereof, the first and second trip-strip extending in opposite directions. For instance, the first pedestal portions may point towards the outer platform 34, while the second pedestal portions may point towards the inner platform 32.

The pedestals 36 and the trip-strips 38 may be integrally cast with the hollow airfoil body 22. The integration of the trip-strips 38 to the ends of the pedestals 36 has the advantage of being easier to cast than pedestals plus pin-fins.

Figure 6:
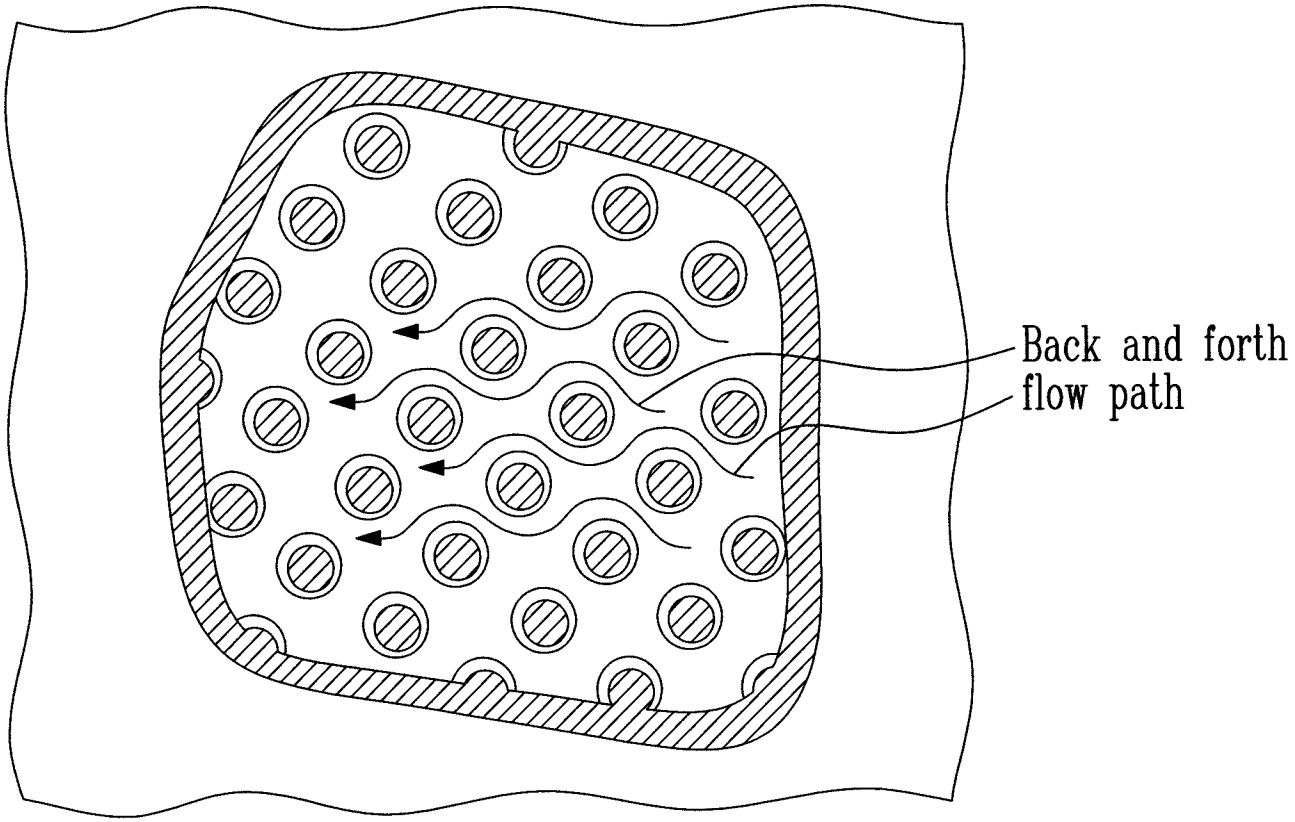
FIG. 6 is an enlarged view showing a back and forth flow path across an array of pedestals.

The flow path through staggered pedestals in the trailing edge region of an internal cooling passage of an airfoil is back and forth as shown in FIG. 6. With the addition of perpendicular short trip-strips 38, the flow path is still primarily back and forth. The heat transfer is enhanced due to the increase in surface area on the trip-strips, and because the flow separates off the trip-strips and re-attaches downstream.

The increase in pressure loss as compared to pedestals alone is slight if the trip-strip height is small compared to the pedestal height, and if the trip-strip does not extend all the way from pedestal to pedestal.

As can be appreciated from the foregoing, the combination of pedestals and trip-strips contributes to enhanced heat transfer while minimizing the coolant pressure drop across these heat exchange promoting features. By so improving the airfoil cooling efficiency, the thermal stress on the airfoil can be reduced and, thus, the service life of the airfoil can be extended. Also, by integrating the trip-strips to the pedestals, the airfoil may be more easily cast than with conventional pedestals alone since a reduced number of integrated "Ped-Trip" features can be used for the same heat transfer.

The above description is meant to be exemplary only, and one skilled in the art will recognize that changes may be made to the embodiments described without departing from the scope of the invention disclosed. For example, while the invention has been described in the context of a turbine vane, it is understood that the same principles could be applied to other types of internally cooled airfoils, including turbine blades. The same principles could also be applied to gas turbine engine components, such as shroud segments and combustor heat shields, as well as applications other than in gas turbine engines where a fluid flows through a passage to provide heat transfer to or from the walls of this passage. Still other modifications which fall within the scope of the present invention will be apparent to those skilled in the art, in light of a review of this disclosure, and such modifications are intended to fall within the appended claims.

What is claimed is:

1. An internally cooled airfoil for a gas turbine engine, comprising a hollow airfoil body having opposed pressure and suction sidewalls defining therebetween a cooling passage, and a plurality of pedestals extending across said cooling passage from said pressure sidewall to said suction sidewall, wherein at least some of said pedestals have a trip-strip portion projecting laterally therefrom a distance less than a distance between two adjacent pedestals, wherein each trip-strip portion has a free distal end opposite to an associated one of the pedestals, the free distal end being spaced from adjacent pedestals.

2. The internally cooled airfoil defined in claim 1, wherein said trip-strip portions are provided on an inner surface of at least one of said pressure and suction sidewalls, the trip-strip portions being oriented perpendicularly to a primary flow direction of coolant through the cooling passage, and wherein the trip-strip portions extend only partway between adjacent pedestals, each trip-strip portion being connected to a single one of said pedestals.

3. The internally cooled airfoil defined in claim 1, wherein the trip-strip portions are provided on an inner surface of both said pressure sidewall and said suction sidewall, the trip-strip portions on the pressure sidewall extending in a direction opposite to that of the trip-strip portions on the suction sidewall.

4. The internally cooled airfoil defined in claim 1, wherein said at least some of said pedestals have first and second trip-strip portions respectively provided on said pressure and suctions sidewalls.

5. The internally cooled airfoil defined in claim 4, wherein said first and second trip-strip portions extend in opposite directions.

6. The internally cooled airfoil defined in claim 1, wherein the airfoil is a turbine vane, and wherein the pedestals having trip-strip portions are staggered in a trailing edge region of the turbine vane.

7. The internally cooled airfoil defined in claim 1, wherein the airfoil body is an airfoil casting, and wherein the pedestals and the trip-strip portions integrally extend from an inner surface of the airfoil casting.

8. The internally cooled airfoil defined in claim 1, wherein the trip-strip portions are disposed perpendicularly to a primary flow direction of coolant through the cooling passage.

9. An internally cooled airfoil for a gas turbine engine, comprising a hollow airfoil body having opposed pressure and suction sidewalls defining therebetween a cooling passage, a plurality of pedestals staggered in a trailing edge region of the cooling passage and extending from said pressure sidewall to said suction sidewall, and a plurality of trip-strips provided on an inner surface of at least one of said pressure and suctions sidewalls, each of said trip-strips having a proximal end attached to an associated one of said pedestals and a distal end spaced-apart from adjacent pedestals, wherein each of the trip-strips extends from only one of said pedestals.

10. The internally cooled turbine vane defined in claim 9, wherein the trip-strips are oriented perpendicularly to a primary flow direction of coolant through the trailing edge region of the cooling passage.

11. The internally cooled turbine vane defined in claim 9, wherein each of the trip-strips extends only partway between adjacent pedestals, the pedestals being interconnected solely by the pressure and suction sidewalls.

12. The internally cooled turbine vane defined in claim 9, wherein the trip-strips project a short distance laterally from respective pedestals, the trip-strips being provided on an inner surface of both the pressure and suction sidewalls.

13. The internally cooled turbine vane defined in claim 12, wherein the trip-strips on the pressure sidewall project in a direction opposite to that of the trip-strips on the suction sidewall.

14. The internally cooled turbine vane defined in claim 9, wherein each pedestal has first and second trip-strips projecting from opposed ends thereof.

15. The internally cooled turbine vane defined in claim 9, wherein a ratio of trip-strip height to pedestal height ranges from 0.05 to 0.25.

16. The internally cooled turbine vane defined in claim 9, wherein a length of the trip-strips varies from 10 to 90% of a lateral distance between adjacent pedestals.

17. The internally cooled turbine vane defined in claim 9, wherein a length of the trip-strips varies from 25 to 50% of a lateral distance between adjacent pedestals.

18. An internally cooled airfoil for a gas turbine engine, comprising a hollow airfoil body having opposed pressure and suction sidewalls defining therebetween a cooling passage, a plurality of pedestals staggered in a trailing edge region of the cooling passage and extending from said pressure sidewall to said suction sidewall, and a plurality of trip-strips provided on an inner surface of at least one of said pressure and suctions sidewalls, each of said trip-strips having a proximal end attached to an associated one of said pedestals and a distal end spaced-apart from adjacent pedestals, wherein each of the trip-strips extends only partway between adjacent pedestals, the pedestals being interconnected solely by the pressure and suction sidewalls.

19. An internally cooled airfoil for a gas turbine engine, comprising a hollow airfoil body having opposed pressure and suction sidewalls defining therebetween a cooling passage, and a plurality of pedestals extending across said cooling passage from said pressure sidewall to said suction sidewall, wherein at least some of said pedestals have a trip-strip portion projecting laterally therefrom a distance less than a distance between two adjacent pedestals, wherein said trip-strip portions are provided on an inner surface of at least one of said pressure and suction sidewalls, the trip-strip portions being oriented perpendicularly to a primary flow direction of coolant through the cooling passage, and wherein the trip-strip portions extend only partway between adjacent pedestals, each trip-strip portion being connected to a single one of said pedestals.

* * * * *